US005921764A

United States Patent [19]

Marchionna et al.

[11] Patent Number: 5,921,764

[45] Date of Patent: Jul. 13, 1999

[54] HEAT ENGINE COMBUSTOR

[75] Inventors: Nicholas R. Marchionna, Ann Arbor; Matthew J. Brusstar, Farmington Hills, both of Mich.

[73] Assignee: Stirling Thermal Motors, Inc., Ann Arbor, Mich.

[21] Appl. No.: 08/897,262

[22] Filed: Jul. 18, 1997

[51] Int. Cl.[6] ..... F23M 3/00

[52] U.S. Cl. ..... 431/9; 431/266; 60/517; 239/405; 239/490; 239/548

[58] Field of Search ..... 239/405, 472, 239/490, 434, 548; 60/517; 431/9, 354, 174, 266, 265

[56] References Cited

U.S. PATENT DOCUMENTS

| | | | |
|---|---|---|---|
| 2,692,014 | 10/1954 | MacCracken . | |
| 2,850,875 | 9/1958 | Gahwyler . | |
| 3,831,380 | 8/1974 | Nederlof . | |
| 4,154,567 | 5/1979 | Dahmen | 431/9 |
| 4,434,766 | 3/1984 | Matsuoka et al. | 239/405 |
| 4,639,212 | 1/1987 | Watanabe et al. . | |
| 4,977,742 | 12/1990 | Meijer . | |
| 5,220,888 | 6/1993 | Khinkis et al. . | |
| 5,388,409 | 2/1995 | Meijer . | |

FOREIGN PATENT DOCUMENTS

| | | | |
|---|---|---|---|
| 519254 | 12/1955 | Canada | 239/548 |

*Primary Examiner*—Carroll B. Dority
*Attorney, Agent, or Firm*—Harness, Dickey & Pierce, PLC

[57] ABSTRACT

A combustor for a heat engine, such as a Stirling cycle heat engine, incorporating a number of nozzles mounted between a pair of plates. Fuel is introduced from above the plates into mixing chambers within the nozzles. Combustion inlet air passing between the plates is introduced into the mixing chambers and create a swirling motion in the fuel/air mixture. The fuel/air mixture passes through an expansion chamber before being discharged to a common combustion chamber. The combustor has been designed to allow the use of high temperature combustion inlet air and to have low NOx emission characteristics.

19 Claims, 2 Drawing Sheets

HEAT ENGINE COMBUSTOR

BACKGROUND AND SUMMARY OF THE INVENTION

This invention is related to a combustor for a heat engine, such as a Stirling cycle heat engine, and particularly to an improved combustor for a heat engine capable of using high temperature combustion inlet air and having low NOx emission characteristics.

Combustors in heat engines are used to burn a fuel, such as natural gas, gasoline or diesel fuel, to produce heat. Heat from the combustion gas produced by burning the fuel is transferred to a working fluid circulating within the heat engine by a heater assembly on the heat engine. The working fluid undergoes a thermodynamic cycle within the heat engine which converts thermal energy in the working fluid into mechanical output energy. This mechanical output energy can be used for a variety of purposes, such as to drive an electrical generator to produce electricity or to drive other mechanical components, such as a vehicle drive train, an irrigation pump, etc.

The heat engine used in conjunction with the inventive combustor can comprise a Stirling cycle heat engine similar to those previously developed by the assignee of the present invention, Stirling Thermal Motors, Inc., including those described in U.S. Pat. Nos. 4,481,771; 4,532,855; 4,615,261; 4,579,046; 4,669,736; 4,836,094; 4,885,980; 4,707,990; 4,439,169; 4,994,004; 4,977,742; 4,074,114, 4,966,841, and 5,611,021, which are hereby incorporated by reference. Basic features of many of the Stirling cycle heat engines described in the above referenced patents may be implemented in connection with a heat engine incorporating the present invention.

Combustion of fuel typically produces three types of hazardous material emissions: volatile organic compounds ("VOCs"), carbon monoxide ("CO"), and oxides of nitrogen ("NOx compounds"), such as nitric oxide (NO), nitrous oxide ($NO_2$), $N_2O_2$, etc. Due to their relatively unstable chemical nature, VOCs and CO are typically comparatively easy to reduce or substantially eliminate, such as through the use of catalyst materials in the exhaust system. NOx compounds, on the other hand, are more chemically stable and more difficult to eliminate after they have been formed during the combustion process.

NOx compounds are formed during a combustion process when the combustion inlet air and fuel are less than thoroughly mixed as the fuel is burned. The quantity of NOx compounds formed also tends to increase as the temperature at which combustion takes place is raised. The most common method for reducing NOx emissions from a combustion process is to optimize the mixing and combustion process and lower the combustion temperature. The lowest emission rates of NOx compounds are currently obtained from combustion systems in which the fuel and combustion inlet air are thoroughly pre-mixed prior to combustion and where the combustion inlet air is at approximately room temperature.

Developing a steady state combustor using pre-mixed fuel and combustion inlet air to reduce the quantity of NOx compounds formed during the combustion process is relatively straightforward when the combustion inlet air is at approximately room temperature. Heat engines, however, typically improve their thermal efficiency (and thereby reduce fuel consumption) by transferring heat from the exhaust combustion gas to the incoming combustion inlet air. This reduces the amount of heat lost in the exhaust gas and substantially increases the overall operating efficiency of the system. By using high efficiency combustion inlet air pre-heaters (a type of heat exchanger), the incoming combustion inlet air can be heated to very high temperatures, approaching 800° C., prior to being mixed with the fuel. Conventional low NOx combustors are not designed or built to operate under such extreme operating conditions. It is also impossible to develop a pre-mixed combustor system if the temperature of the combustion inlet air substantially exceeds the autoignition temperature of the fuel/air mixture. When the temperature of the combustion inlet air substantially exceeds the autoignition temperature of the fuel, the use of such a pre-mixed system would result in the premature ignition of the fuel/air mixture and could lead to the eventual destruction of the combustor assembly.

The inventive combustor allows the use of high temperature combustion inlet air while at the same time substantially limiting the formation of NOx compounds during the combustion process. The combustor incorporates a large number of nozzles that each mix a portion of the fuel and combustion inlet air together in an internal mixing chamber before the swirling fuel/air mixture is discharged into a collective combustion chamber. Low pressure regions are created as fuel/air mixture is discharged from the nozzles, which helps to circulate the combustion gas back into the wakes produced by the nozzle discharge. This stable aerodynamic swirling pattern and circulation of the combustion gas within the combustion chamber provides a continuous combustion process so that an igniter (i.e. a spark plug) is only required to start the combustion process. The stability of the combustion process allows for a wide range of operating conditions without additional mechanical contrivances.

The inventive combustor is provided with an igniter that initiates combustion of the fuel/air mixture when the heat engine is being started. As the components of the heat engine warm, the temperature of the combustion inlet air is raised until the combustion inlet air temperature has increased sufficiently to allow the temperature of the fuel/air mixture to exceed its autoignition temperature. The nozzles in the inventive combustor have been designed to provide rapid and efficient mixing of the combustion inlet air and fuel and combustion of the fuel/air mixture even when the temperature of the combustion inlet air substantially exceeds the autoignition temperature of the fuel/air mixture. This results in very low production of NOx compounds, even at very high combustion inlet air temperatures. In tests performed on the inventive combustor in which the temperature of the combustion inlet air approached 800° C., the production of NOx compounds was so low that the levels could not be measured by the laboratory test equipment (i.e. the quantity of NOx compounds in the exhaust combustion gas was less than 1 part per million). By manufacturing the components of the innovative combustor from high-temperature alloys, such as Inconel 713C, the combustor is able to operate properly even under severe operating conditions, such as when the combustion inlet air temperature approaches 800° C.

The inventive combustor also features a short flame length, which helps to reduce the size of the required combustion chamber. Having a relatively small combustion chamber is particularly important for mobile heat engine applications, such as motor vehicle applications.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
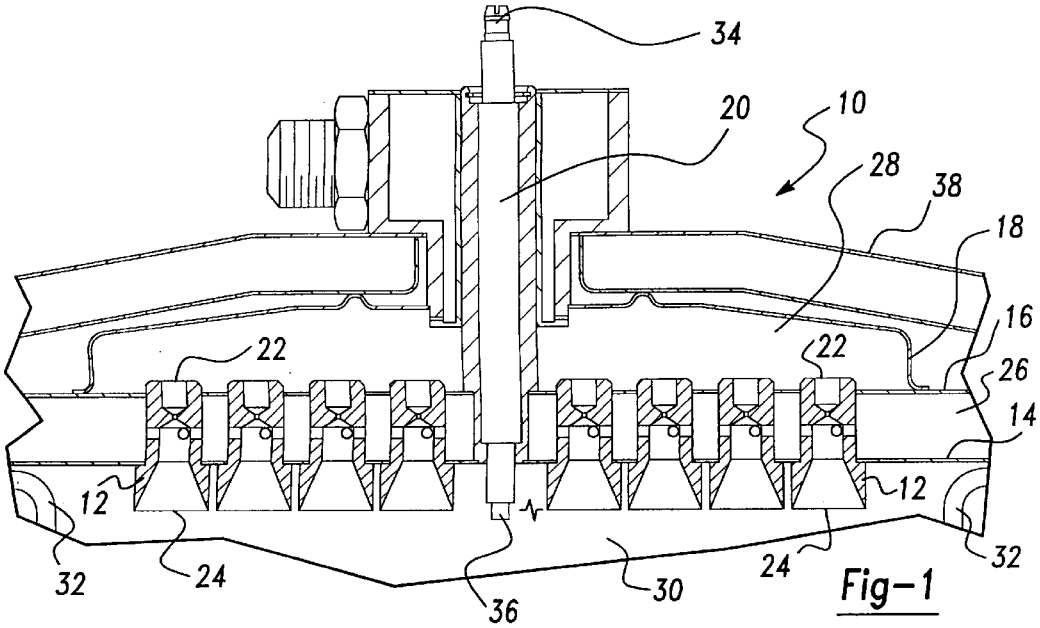
FIG. 1 is a cross-sectional view through a heat engine combustor in accordance with this invention.

A heat engine combustor in accordance with this invention is shown in an assembled and installed condition in FIG. 1 and is generally designated by reference number 10. Combustor 10 includes a number of components including nozzles 12, lower plate 14, upper plate 16, fuel chamber housing 18, and igniter 20.

Overall Construction

Combustor 10 has been designed to allow the use of high temperature combustion inlet air while simultaneously producing low levels of NOx emissions. This is accomplished by having a large number of nozzles 12 that each simultaneously mix together a portion of the fuel and combustion inlet air before the fuel/air mixture is discharged into the combustion chamber. This design allows for the lean burning of the fuel and air mixture.

Nozzles 12 have fuel intake ends 22 and fuel/air mixture discharge ends 24. Lower plate 14 and upper plate 16 are assembled parallel to one another and each of the plates contain a number of holes that are aligned when the plates are placed in proper position. Nozzles 12 are placed within these holes, so that the fuel intake ends 22 of nozzles 12 extend above upper plate 16 and the fuel/air mixture discharge ends 24 of nozzles 12 extend below lower plate 14. As shown, the fuel intake ends 22 and fuel/air mixture discharge ends 24 of nozzles 12 form parallel opposed planar surfaces when the nozzles 12 are installed within lower plate 14 and upper plate 16. The shapes and operating characteristics of the nozzles 12 are described in substantially more detail below.

The space between lower plate 14 and upper plate 16 comprises a combustion inlet air chamber 26. Intake combustion inlet air is drawn into the heat engine by a blower or fan (not shown) which moves the air through a pre-heater (described below) and into the combustion inlet air chamber 26 under positive pressure. The space between upper plate 16 and fuel chamber housing 18 comprises fuel chamber 28. Fuel is supplied into fuel chamber 28 under positive pressure, such as by a tank or supply line. The fuel and combustion inlet air are mixed within nozzle 12, creating a swirling fuel/air mixture, which is then discharged into combustion chamber 30 where the mixture is burned. The combustion gas resulting from the burning of the fuel/air mixture flows between heater tubes 32 where a portion of the heat in the combustion gas is transferred to a working fluid passing through heater tubes 32. After passing between heater tubes 32, the combustion gas passes through a pre-heater, a type of heat exchanger, that warms the incoming combustion inlet air with heat from the exhaust combustion gas. A pre-heater of the type shown in FIGS. 1A, 25, 26, 27 and 28 and described in columns 15 and 16 of the Specification of U.S. Pat. No. 5,611,201 could be used for this purpose. The exhaust gas is then discharged from the heat engine.

When the heat engine is started, initial combustion of the fuel/air mixture is initiated by an igniter 20. An electrical connector connected to an external end 34 of the igniter 20 applies an electrical current and this causes a spark to jump from an internal end 36 of igniter 20, positioned below lower plate 14, to one of the adjacent metal nozzles 12. This spark causes the initial ignition and burning of the fuel/air mixture. After a stable flame front has been established within combustion chamber 30, igniter 20 may be inactivated.

The combustor 10 is encased within a combustor housing 38. The combustor housing 38 preferably helps to insulate combustor assembly 10 to reduce the loss of heat from the combustor 10 and to increase the thermal efficiency of the heat engine. One method for insulating the combustor 10 is to provide a combustion housing 38 having separate external and internal surfaces, as shown, with a insulative layer between these surfaces.

Figure 2:
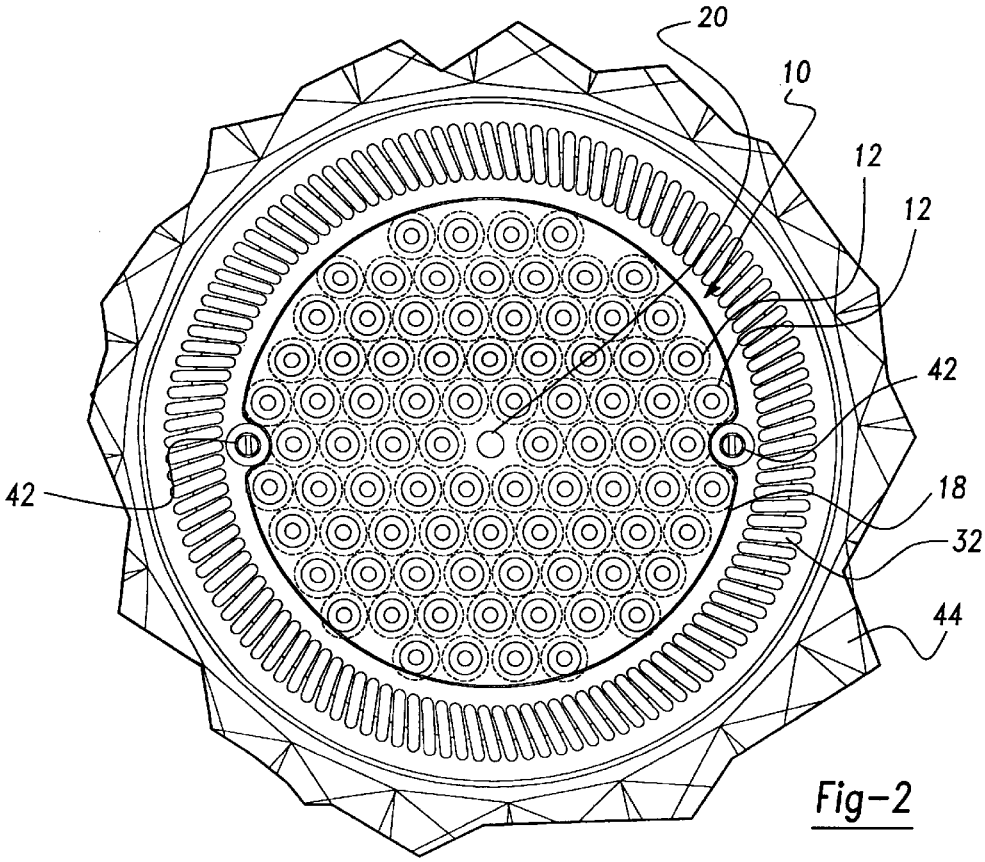
FIG. 2 is a top view through the combustor from FIG. 1.

FIG. 2 shows a top down view of combustor 10 taken from the vicinity of top plate 16. FIG. 2 more clearly shows that the nozzles 12 are tightly packed about igniter 20. As shown in FIG. 2, it is preferable to have each of the nozzles 12 equidistantly spaced with respect to each of the adjacent nozzles and to utilize the maximum number of nozzles possible. Equally spacing the nozzles and incorporating the largest possible number of nozzles improves the evenness of the distribution of the fuel/air mixture and reduces the formation of NOx compounds. FIG. 2 shows that when the nozzles 12 are round and tightly packed, the gaps between the nozzles may consist of triangularly shaped regions that are joined to other triangularly shaped regions at the corners. Also shown are the outer periphery of fuel chamber housing 18 as well as fasteners 42, which are used to fasten the fuel chamber housing 18 to the other components of the combustor 10.

Also shown in FIG. 2 are portions of the heater tubes 32 and the pre-heater 44. As discussed above, after the fuel/air mixture has been burned, the combustion gas passes between heater tubes 32 which have working gas circulating within them. In the embodiment of the heat engine shown in FIG. 2, the heater tubes 32 have an inverted "U" shape and only the curved portion at the top of the tubes are visible. A portion of the heat in the combustion gas is transferred to working gas inside the heater tubes 32 as the combustion gas passes between the heater tubes. The combustion gas then passes through pre-heater 44. Pre-heater 44 is a heat exchanger which transfers heat from the combustion gas to the incoming combustion inlet air. Numerous pre-heater designs for heat engines are known to those of ordinary skill in the art. After passing through the pre-heater 44, the combustion gas is exhausted from the heat engine.

The Nozzles

Figure 3:
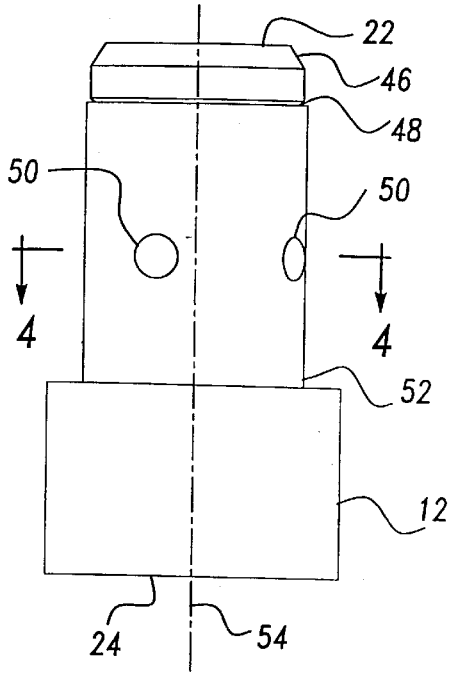
FIG. 3 is an enlarged side view of a combustor nozzle in accordance with this invention.
Figure 4:
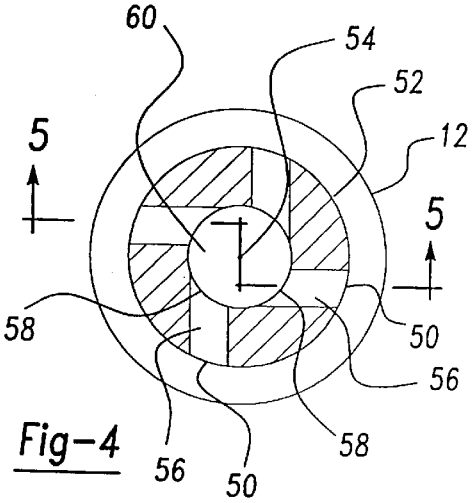
FIG. 4 is an enlarged cross-sectional view of the nozzle taken along line 4—4 of FIG. 3.
Figure 5:
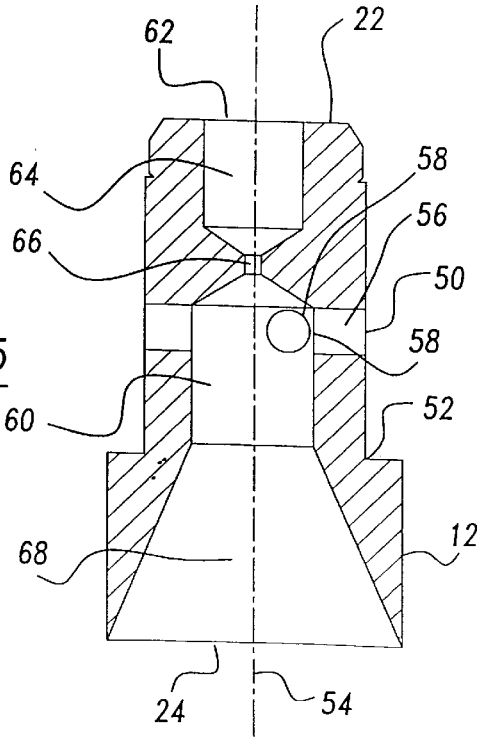
FIG. 5 is an enlarged longitudinal cross-sectional view of the nozzle taken along line 5—5 of FIG. 4.

The geometries of the nozzles 12 are shown in detail in FIGS. 3, 4 and 5. FIG. 3 shows an external view of a nozzle 12. The fuel intake end 22 of the nozzle 12 has a tapered upper section 46 which helps to pilot the fuel intake end 22 as it is placed within the holes in the lower plate 14 and the upper plate 16 during assembly. The fuel intake end 22 of the nozzle 12 also has an upper annular recess 48. The upper annular recess 48 allows nozzle 12 to be press fit into and retained by upper plate 16 when the combustor 10 is assembled. Also visible in FIG. 3 are external combustion inlet air ports 50, through which combustion inlet air enters the nozzle 12. In the embodiment of the inventive nozzle 12 depicted, four external combustion inlet air ports 50 are present, two of which are visible in FIG. 3. A lower annular recess area can similarly be added to the flange transition area 52 of the nozzle 12, to allow the nozzle to be similarly press fit into and retained by lower plate 14 when the combustor 10 is assembled. The central axis 54 of the nozzle 12 is also depicted in FIG. 3. Other than the combustion inlet air passageways and their associated ports, discussed below, the nozzles 12 are completely symmetric about their respective central axes 54.

FIG. 4 shows a top down cross-sectional view of the nozzle from FIG. 3 taken along line 4—4, through the centers of external combustion inlet air ports 50. This view shows that external combustion inlet air ports 50 are openings into combustion inlet air passageways 56. The combustion inlet air enters the nozzle 12 through external combustion inlet air ports 50, passes through combustion inlet air passageways 56 and internal combustion inlet air ports 58, and into mixing chamber 60. To promote proper mixing of the combustion inlet air and fuel and reduce the formation of NOx compounds during combustion, it is important that the fuel/air mixture swirls as it is discharged from nozzle 12. To produce this swirling motion, the internal combustion inlet air ports 58 are equally spaced about the central axis 54 and the combustion inlet air is introduced into mixing chamber 60 through the combustion inlet air passageways 56 and the internal combustion inlet air ports 58 so that streamlines depicting the mass flow of the combustion inlet air entering the mixing chamber 60 are tangent to a common circle, and this circle has its centerpoint on the central axis 54.

FIG. 5 shows a side cross-sectional view of the nozzle 12 from FIGS. 3 and 4, taken along line 5—5 from FIG. 4. Fuel enters nozzle 12 through external fuel port 62, passes through fuel passageway 64 and throat 66 and enters mixing chamber 60. As discussed above with respect to FIG. 4, combustion inlet air enters mixing chamber 60 from four internal combustion inlet air ports 58 and creates a swirling motion which mixes the fuel and the combustion inlet air. The fuel/air mixture is discharged from mixing chamber 60 into expansion chamber 68 and then into combustion chamber 30, as discussed above. The expansion chamber 68 provides a transition between the relatively high velocities in the mixing chamber 60 and the relatively low velocities in the combustion chamber 30. Mixing of the combustion inlet air and fuel not only takes place within the mixing chamber 60, but continues to take place within the expansion chamber 68 and the combustion chamber 30.

The inventive combustor 10 has been particularly designed to allow the temperature of the combustion inlet air to significantly exceed the autoignition temperature of the fuel/air mixture. When the temperature of the combustion inlet air significantly exceeds the autoignition temperature of the fuel/air mixture, combustion begins to occur in the mixing chamber 60 as the molecules of fuel and combustion inlet air are mixed together. To reduce the possibility of autoigniting the fuel in the fuel chamber 28 and to promote the thorough mixing of the combustion inlet air and fuel, it is desirable that throat 66 have as small a cross-section as reasonably possible. A throat diameter slightly less than 1 millimeter has been used for nozzles approximately 32 millimeters in length with a mixing chamber 60 approximately 8 millimeters in diameter and combustion inlet air passageways 56 approximately 2.5 millimeters in diameter.

The nozzles 12 and the other components of the inventive combustor, such as lower plate 14 and upper plate 16, are preferably fabricated from high temperature alloys, such as superalloy materials. Superalloys have been developed for very high temperature applications where relatively high stresses are encountered (such as tensile, thermal, vibratory and shock stresses) and oxidation resistance is often required. Such superalloys are routinely used in jet-engine combustor applications. By fabricating all of the components of combustor 10 from the same superalloy material, problems which could be caused by differences in material properties, such as differences in thermal expansion, can be avoided. Applicants believe that nickel-based, cobalt-based, and iron-based superalloys offer the best performance characteristics for the components of the inventive combustor. The preferred superalloy for the components of the combustor is Inconel 713C. This alloy is nickel-based and includes significant proportions of chromium, aluminum and molybdenum. The operating temperature of combustor components fabricated from Inconel 713C is approximately 1000° C., approximately 200° C. higher than the operating temperatures of combustor assemblies manufactured utilizing conventional materials.

By incorporating a large number of nozzles 12 in the combustor 10, each of which has multiple combustion inlet air passageways 56, the effective area through which the combustion inlet air may flow is relatively high. This results in a substantially reduced pressure drop for the combustion inlet air across the nozzles when compared to conventional combustors. This reduction in pressure drop across the combustor allows the use of a lower pressure blower or fan, thereby saving both manufacturing costs in the construction of the heat engine as well as reduced energy consumption by this component during the operation of the heat engine.

The disclosed embodiment of the combustor 10 has been designed to be both relatively simple to manufacture and capable of providing a long service-free life. Alternative embodiments of the combustor 10 could be readily developed without significantly changing the operating characteristics of the combustor by substituting components having equivalent functionality. Igniter 20, for instance, could utilize a heated element or could generate a spark by a piezoelectric effect. A variety of alternative methods for supplying fuel and combustion inlet air to the nozzles 12, such as piping or conduit, could similarly be substituted for the lower plate 14, upper plate 16 and fuel chamber housing 18 described above.

While the depicted embodiments of the inventive combustor 10 and nozzle 12 have been optimized to burn typical gaseous fuels, such as natural gas, the combustor and nozzle could be readily adapted to burn other types of fuels, such as vaporized gasoline. The depicted embodiment of the combustor 10 has been particularly designed for use in connection with Assignee's 4-120 Stirling Engine Power Conversion System heat engine.

The inventive combustor 10 could be used in connection with an Ultra Low Emission Vehicle ("ULEV Vehicle"), where the heat engine is either directly connected to the vehicle drive train or where the heat engine is used as an auxiliary power unit in a hybrid electric vehicle. The ULEV standard requires a vehicle to emit no more than 0.2 grams of NOx compounds per mile traveled. Tests performed on the inventive combustor 10 produced NOx compound emissions below 1 part per million, which would place a vehicle utilizing such a heat engine/combustor assembly well within this ULEV standard. The inventive combustor 10 has a short flame length, which allows the use of a relatively small combustion chamber and a compact combustor/heater assembly. This is particularly important for an application requiring the heat engine to be transportable, such as a vehicle engine application, where packaging requirements are quite stringent.

It is to be understood that the invention is not limited to the exact construction illustrated and described above, but that various changes and modifications may be made without departing from the spirit and scope of the invention as defined in the following claims.

We claim:

1. A combustor for a heat engine, said combustor comprising:

a housing defining a combustion chamber, fuel chamber means for forming a fuel chamber in said housing, air chamber means for forming an air chamber in said housing, a plurality of individual nozzles located in said housing, wherein each of said nozzles is unitarily constructed and physically distinct from said fuel chamber means and said air chamber means, fuel supply means for supplying fuel to said nozzles through said fuel chamber means, combustion inlet air supply means for supplying combustion inlet air to said nozzles, each of said nozzles having a fuel inlet in communication with said fuel chamber means and an air inlet in communication with said air chamber means, each of said individual nozzles also having a mixing chamber tangentially oriented to said air inlet, and a discharge port, said mixing chamber allowing the fuel and the combustion inlet air to be mixed together within said mixing chamber to produce a swirling fuel/air mixture, said discharge port allowing the fuel/air mixture to be discharged from said mixing chamber to said combustion chamber through said discharge port, and ignition means for igniting the fuel/air mixture.

2. A combustor according to claim 1 wherein said fuel supply means introduces the fuel into each of said mixing chambers as a single stream.

3. A combustor according to claim 1 wherein said combustion inlet air supply means introduces the combustion inlet air into each of said mixing chambers as a plurality of combustion inlet air streams.

4. A combustor according to claim 3 wherein said combustion inlet air streams define streamlines depicting the mass flow of the combustion inlet air entering said mixing chamber, and said streamlines are tangent to a common circle.

5. A combustor according to claim 1 wherein each of said nozzles are identical.

6. A combustor according to claim 1 wherein said nozzles are spaced equidistantly apart.

7. A combustor according to claim 1 wherein said nozzles are aligned along a common plane.

8. A combustor according to claim 1 wherein the combustion inlet air has a temperature exceeding 700° C.

9. A combustor according to claim 1 wherein the fuel/air mixture has an autoignition temperature and the combustion inlet air has a temperature greater than the autoignition temperature of the fuel/air mixture.

10. A combustor according to claim 1, wherein said air chamber means comprises a pair of plates defining said air chamber between said plates.

11. A combustor for a heat engine, said combustor comprising:

a housing defining a combustion chamber, a plurality of identical nozzles connected to said housing and spaced equidistantly apart, wherein each of said identical nozzles is unitarily constructed and physically distinct from said housing, fuel supply means for supplying fuel to said nozzles, combustion inlet air supply means for supplying combustion inlet air to said nozzles, each of said nozzles having a mixing chamber and a discharge port, said mixing chamber allowing the fuel and the combustion inlet air to be mixed together within said mixing chamber to produce a swirling fuel/air mixture, said discharge port allowing the fuel/air mixture to be discharged from said mixing chamber to said combustion chamber through said discharge port, each of said nozzles further having a throat and a plurality of combustion inlet air passageways, said throat having a smaller cross-sectional flow area than said combustion inlet air passageways, said fuel supply means supplying the fuel to said mixing chamber as a single stream through said throat, said combustion inlet air supply means supplying the combustion inlet air to said mixing chamber as a plurality of combustion inlet air streams through said combustion inlet air passageways, the combustion inlet air streams defining streamlines depicting the mass flow rate of the combustion inlet air, said streamlines tangent to a common circle, and ignition means for igniting the fuel/air mixture.

12. A nozzle assembly for mixing combustion inlet air and fuel to produce a fuel/air mixture, said nozzle assembly comprising:

an array of nozzles, each said nozzle having a nozzle body having a mixing chamber, a fuel inlet port, a fuel passageway, a combustion inlet air inlet port, a combustion inlet air passageway, and a fuel/air mixture discharge port, said fuel passageway allowing fuel to enter said mixing chamber through said fuel inlet port, said combustion inlet air passageway allowing combustion inlet air to enter said mixing chamber through said combustion inlet air inlet port, said fuel passageway having a throat between said fuel inlet port and said mixing chamber through which fuel must pass before entering said mixing chamber, said throat having a smaller cross-sectional flow area than said mixing chamber, said mixing chamber allowing fuel entering said mixing chamber from said fuel inlet and combustion inlet air entering said mixing chamber from said combustion inlet air inlet to be mixed within said mixing chamber to produce a fuel/air mixture, said fuel/air mixture discharge port allowing the fuel/air mixture to be discharged from said nozzle through said fuel/air mixture discharge port;

a first plate and second plate coupled to said array of nozzles, wherein said first and second plates are separated to form a generally continuous air intake chamber for introducing said combustion air to said array of nozzles, said array of nozzles positioned between said first and second plates with said combustion inlet air ports located in said air intake chamber; and a fuel chamber for introducing fuel to said array of nozzles.

13. A nozzle assembly according to claim 12 wherein each said nozzle body consists of a single piece of material.

14. A nozzle assembly according to claim 12 wherein each said nozzle has a central axis and said combustion inlet air passageway allows the combustion inlet air to be introduced into said mixing chamber along a plane perpendicular to said central axis.

15. A nozzle assembly according to claim 12 wherein each said nozzle has a central axis and said combustion inlet air passageway allows the combustion inlet air to be introduced into said mixing chamber along a plane perpendicular to said central axis.

16. A nozzle assembly according to claim 12 wherein each said nozzle body further has an expansion chamber between said mixing chamber and said discharge port, said expansion chamber having an increasing cross-sectional flow area between said mixing chamber and said discharge port.

17. A method of burning a fuel, such as natural gas, to produce low levels of NOx compound emissions, said method comprising:

providing a plurality of unitarily constructed physically distinct nozzles, each of said unitarily constructed physically distinct nozzles having a central axis, a fuel inlet port centered about said central axis, a plurality of combustion inlet air inlet ports spaced evenly about said central axis, and an fuel/air mixture discharge port centered about said central axis opposite said fuel inlet port, introducing streams of fuel providing a fuel chamber into said unitarily constructed physically distinct nozzles along said central axes through said fuel inlet ports, providing an air chamber introducing streams of combustion inlet air from said air chamber into said unitarily constructed physically distinct nozzles through said combustion inlet air inlet ports, said streams of combustion inlet air defining streamlines depicting the mass flow of the combustion inlet air, said streamlines associated with a common mixing chamber being tangent to a common circle, said streams of fuel and streams of combustion inlet air producing fuel/air mixtures swirling about said central axis within each said unitarily constructed physically distinct nozzle, discharging the fuel/air mixtures into said combustion chamber through said fuel/air mixture discharge ports, and igniting the fuel/air mixtures.

18. A method according to claim 17 wherein said streamlines associated with a common mixing chamber lie on a common plane and said plane is perpendicular to said central axis.

19. A method according to claim 17 wherein the fuel/air mixtures have an autoignition temperature and the combustion inlet air has a temperature greater than the autoignition temperature of the fuel/air mixtures.

* * * * *